United States Patent [19]

De Marchi

[11] Patent Number: 4,682,426

[45] Date of Patent: Jul. 28, 1987

[54] SKI BOOT TIGHTENING DEVICE

[75] Inventor: Jean-Louis De Marchi, Duingt, France

[73] Assignee: Salomon S.A., Annecy, France

[21] Appl. No.: 867,988

[22] Filed: May 29, 1986

[30] Foreign Application Priority Data

May 31, 1985 [FR] France ..... 85 08207

[51] Int. Cl.[4] ..... A43C 11/00; A43B 5/04

[52] U.S. Cl. ..... 36/50; 36/117; 36/121; 24/68 CD; 24/68 SK

[58] Field of Search ..... 36/117–121, 36/50; 24/68 CD, 68 SK, 69 SK, 70 SK, 71 SK

[56] References Cited

U.S. PATENT DOCUMENTS

| | | | |
|---|---|---|---|
| 357,287 | 2/1887 | Nolte | 24/70 SK |
| 4,120,076 | 10/1978 | Lebre | 24/68 CD |
| 4,150,500 | 4/1979 | Delery | 36/117 |
| 4,596,080 | 6/1986 | Benoit et al. | 36/120 |
| 4,619,057 | 10/1986 | Sartur et al. | 36/50 |

FOREIGN PATENT DOCUMENTS

| | | | |
|---|---|---|---|
| 1805009 | 5/1970 | Fed. Rep. of Germany | 24/69 SK |
| 3244506 | 7/1983 | Fed. Rep. of Germany | 36/117 |
| 3524792 | 1/1986 | Fed. Rep. of Germany | 36/117 |
| 2561878 | 10/1985 | France | 36/117 |
| 721545 | 11/1966 | Italy | 24/70 SK |

*Primary Examiner*—James Kee Chi

*Attorney, Agent, or Firm*—Pollock, Vande Sande & Priddy

[57] ABSTRACT

Device for tensioning a flexible element assuring a connection between two pieces, particularly applicable to the closure and tightening of a ski boot. The flexible element (7) passes around a first, movable counter-element carried by a pivoting tensioning lever (6), forming a first loop (*7a, 7b*), then around a second fixed counter-element (11, 16, 27), forming a second loop (*7b, 7c*), the flexible connecting element (7) and the two counter-elements constituting the equivalent of a clamp.

14 Claims, 8 Drawing Figures

SKI BOOT TIGHTENING DEVICE

FIELD OF THE INVENTION

The present invention relates to a device for tensioning a flexible element assuring a connection between two pieces, particularly applicable to the closure and clamping of a ski boot on the foot of a skier.

BACKGROUND OF THE INVENTION

Devices for the closure and clamping of ski boots are already known in the art. Such devices comprise, on one of the two boot parts to be tightened, a closure lever pivotable about a transverse axis and solid with a first end of a flexible connecting element, such as a cable, whose second end is attached to the second part of the boot. Such a device for closure and tensioning of a flexible element constitutes an articulation of the toggle joint type, the pivoting axis of the closure lever being located between the two ends of the flexible element when the two parts of the boot are drawn against one another.

Such closure and clamping devices have the drawback that they allow only relatively limited travel of the two parts of the boot during opening and closure of the latter. Such limited travel is inherent in the structure of the device in which the flexible connecting element extends only and directly up to the control lever to which it is connected.

SUMMARY OF THE INVENTION

The present invention overcomes this drawback by providing a device of particularly simple design which allows a relatively long course of travel for the flexible connecting element during opening and closure operations.

For this pupose, the tensioning device according to the invention, comprising a support on which a lever is mounted for pivoting movement about a transverse axis, this lever controlling the tensioning of the flexible connecting element which is attached, at its respective ends, to two pieces, is characterized by the fact that the flexible connecting element passes around a first, movable counter-element carried by the lever, forming a first loop, and then around a second, fixed counter-element, forming a second loop, the flexible connecting element and the two counter-elements constituting the equivalent of a clamp.

Preferably, the fixed counter-element is located on that side of the pivoting axis of the lever which is opposite to the one where the movable counter-element carried by the lever is located when the latter is flat on its support, i.e., in tensioning position.

According to another feature of the invention, the device is provided with means enabling adjustment of the tension to which the connecting element is subjected when the lever is in closure position.

According to a first embodiment of the invention, these tension adjusting means may comprise means enabling longitudinal displacement, on the tensioning lever, of the position of the first counter-element around which the connecting element passes to form the first loop.

According to a second embodiment, the tension adjustment means are designed to vary the vary the longitudinal position of the second counter-element.

According to a further feature of the invention, the flexible connecting element is preferably constituted by a flat strap of very limited thickness, considerably reducing its space requirment.

BRIEF DESCRIPTION OF THE DRAWINGS

In order that the invention may be more clearly understood, reference will now be made to the accompanying drawings, in which several embodiments of the invention are shown for purposes of illustration, and in which.

DETAILED DESCRIPTION

Figure 1:
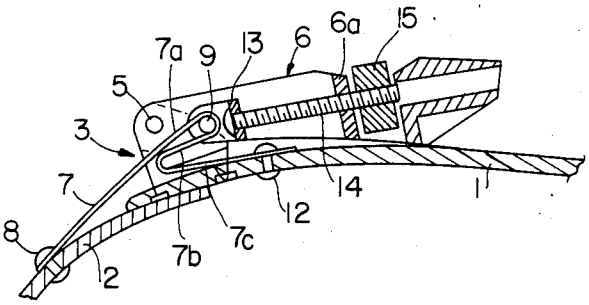
FIG. 1 is a longitudinal section view of a tensioning device according to the invention, with the pivoting lever in closed position.
Figure 2:
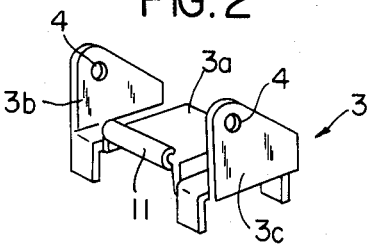
FIG. 2 is a perspective view of the support on which the lever is pivotably mounted.

The tensioning device shown in FIG. 1 and 2 is provided for bringing together and keeping in tightened relation two parts 1 and 2, e.g., of a ski boot. On the first piece 1 is fixed a support in the form of a cap 3 whose web portion 3*a* is in contact with the first piece 1 while its wings 3*b* and 3*c* extend perpendicularly toward the exterior, from web portion 3*a*. The latter may be attached to piece 1 by means of crimped fixing lugs. The two wings 3*b* and 3*c* are provided with coaxial holes 4 for receiving a transverse axle 5 permitting pivoting of tensioning lever 6.

Closure and clamping of the two parts 1 and 2 are assured by a flexible connecting element 7, which is preferably constituted by a flat strap. This strap 7 may be entirely inextensible, e.g., where it contributes to clamping of the leg of the skier inside the boot, or slightly extensible, e.g., when it is used for closure and tightening of the boot upper. In the latter case, it allows a certain flexibility of the upper in its closed position, due to the fact that the movable front portion of the upper can oscillate slightly about its lower axis of articulation on the shell base.

The strap 7 is hooked at a first end 8 to the second part 2, and extends in the direction of the first part 1. More particularly, as shown in FIG. 1, strap 7 forms, beginning at its end 8, a rectilinear strand 7*a* extending up to a movable counter-element 9 carried by pivoting lever 6, the strap 7 passing around such element and returning in the direction of the second part 2 through a strand 7*b*. The two strands 7*a* and 7thus form a loop supported by counter-element 9 and opening in the direction of the second part 2. The second strand 7*b* of this loop in turn passes around a second, fixed counter-element 11, parallel to the first element 9, forming, with a third end strand 7*c*, a second loop 7*b*, 7*c* facing opposite to loop 7*a*, 7*b*. The end of strand 7*c* is attached to the first part 1 by any appropriate means, e.g., a rivet 12.

Preferably, the fixed counter-element 11 is located on that side of the pivoting axis 5 of tensioning lever 6 where the movable counter-element 9 carried by lever 6 is located when the latter is flat on its support 3, i.e., in tensioning position As may be seen in FIGS. 1 and 2, the fixed counter-element 11 of strap 7 is preferably constituted by a front rim of web portion 3*a*, this rim 11 being arched toward the exterior and preferably having a rounded profile. As a result, strap 7 passes around the rounded rim 11 forming the second, fixed counter-element, and then under web 3*a* and to attachment rivet 12.

From the preceding description, it will be clear that the tensioning device according to the invention uses a clamp defined by two counter-elements 9 and 11 around which passes strap 7, this clamp being able to absorb or release a relatively great length of strap 7 resulting in less consumption of space.

The portion of the fixed counter-element 11 of strap 7, with respect to portions of the pivoting axis 5 and counter-element 9, may be selected in accordance with the desired clearance.

In the embodiment shown in FIGS. 1 and 2, counter-element 11 is fixed on cap 3 contsituting the support for pivoting lever 6, while movable counter-element 9 can be adjusted longitudinally in order to vary the tension of strap 7. To this end, counter-element 9 is advantageously constituted by an axle extending between the two wings of a cap 13 whose position can be adjusted longitudinally inside pivoting lever 6. The web of this movable cap 13 is solid with a longitudinally threaded rod 14 which extends through a hole in a transverse wall 6*a* supporting pivoting lever 6. A knurled nut 15 screwed on the end portion of threaded rod 14 effectively abuts against wall 6*a*. Rotation of nut 15 therefore causes transitional movement of rod 14 in one or the other direction, thereby changing the longitudinal position of counter-element 9 on lever 6, and hence the tension of strap 7.

Figure 3:
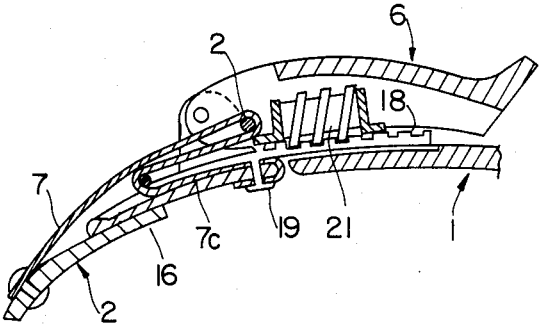
FIG. 3 is a longitudinal section view of a second embodiment of the device.
Figure 4:
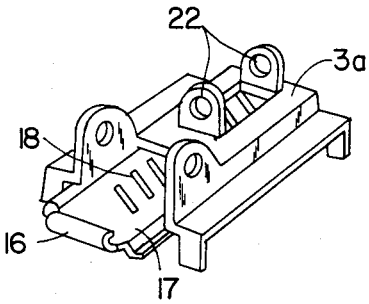
FIG. 4 is a perspective view of the support for the lever shown in FIG. 3.

In the embodiment shown in FIGS. 3 and 4, counter-element 9 is fixedly mounted on pivoting lever 6, and counter-element 11 of strap 7 is longitudinally adjustable. In this embodiment, the cap-shaped support 3 for pivoting lever 6 carries, under its web portion 3*a*, a longitudinally movable small slab 17 with a rack 18 in its upper face. This slab has a rounded rim 16 at its front end, facing outwardly and constituting the second counter-element for strap 7. The latter thus forms, between slab 17 and the second part 2, the third strand 7*c*, which is attached at its end to the second part 2, e.g., by a rivet 19. Longitudinal movement of slab 17 is obtained by means of an endless screw 21 engaging the teeth of rack 18 and mounted for rotation about a horizontal axis, between two lugs 22 extending from web portion 3*a* of support 3. Rotation of endless screw 21 in one direction or the other thus causes longitudinal translational movement of slab 17, and hence displacement of forward rim forming a counter-element for strap 7, thereby causing variation of the tension of the strap in closure position of the device.

Figure 5:
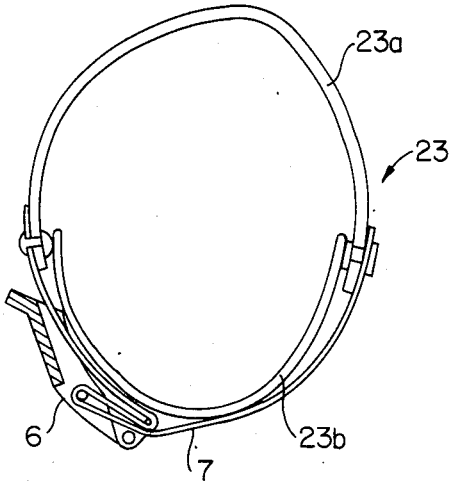
FIG. 5 is a horizontal section view of the tensioning device according to the invention, applied to the tightening of the upper of a ski boot on the lower part of the leg of a skier.

FIG. 5 shows the application of the device according to the invention to the clamping of an upper 23 of a ski boot comprising front and rear parts movable with respect to one another and surrounding the leg of the skier. Strap 7 extends horizontally in front of the forward part 23*b* of upper 23 and is attached, at its two ends, to the two edges of the rear part 23*a* of upper 23. In this case, the device for tensioning strap 7 is free, i.e., it is not fixed to the forward part 23*b* of upper 23, and it is maintained in position simply by the passage through it of strap 7, forming a first loop around the first counter-element 9 and a second loop around the second counter-element 11.

Figure 6:
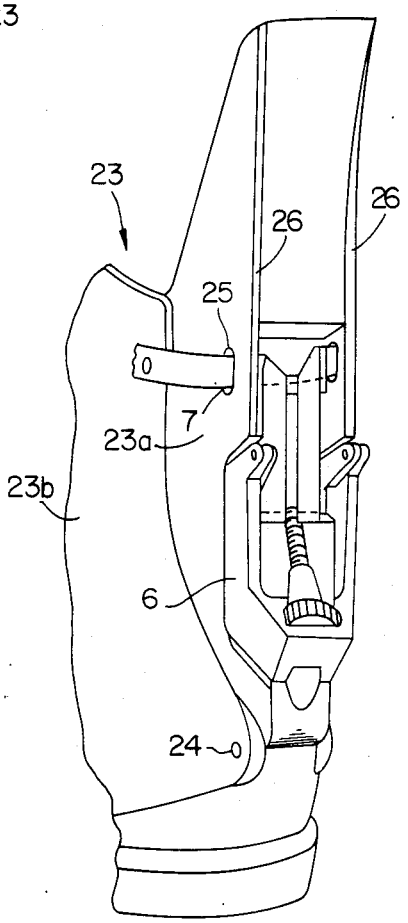
FIG. 6 is a perspective view of the rear of a ski boot provided with a device for tensioning straps assuring tightening of the upper of the boot on the lower part of the leg of the skier.
Figure 7:
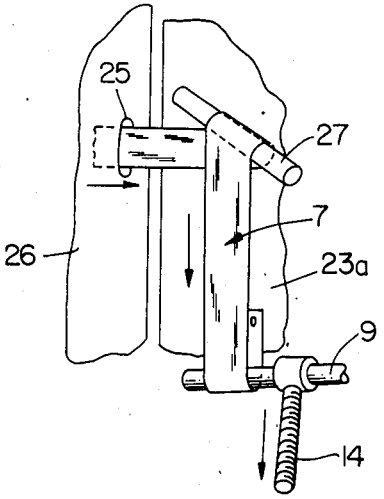
FIG. 7 is an enlarged scale view, partly in perspective, of the tensioning device shown in FIG. 6.

In the embodiment shown in FIGS. 6 and 7, tensioning lever 6 is mounted for pivoting movement about a horizontal and transverse axis on the rear part 23*a* of ski boot, and assures closure and clamping of the boot upper. More particularly, rear part 23 is solid with the shell base of the boot, and the front part 23*b* of the upper is mounted on rear part 23*a* for pivoting movement about a lower axis 24. In this case, clamping of the lower part of the leg is effected by two straps 7 respectively attached to the two sides of the pivoting forward part 23*b* of upper 23, at points near the top of this part. Each of these straps 7 extends through an elongated hole 25 in a vertical rib 26, hence horizontally. Each strap 7 is then deflected vertically downwardly, passing over an inclined deflection bar 27 constituting, in this case, the second, fixed counter-element, and it forms, at its lower portion, a loop around the first, movable counter-element 9 carried by pivoting lever 6. This movable counter-element 9 is constituted by a horizontally and transversely extending axle solid with an end of the threaded rod 14 which extends downwardly and which, by means of knurled nut 15, permits adjustment of the tension of straps 7. Each of the latter is fixed, at the upper end of the strap turned upwardly and forming the loop about counter-element 9, at a point located between the two ribs 26 of the rear part 23*a* of upper 23.

Figure 8:
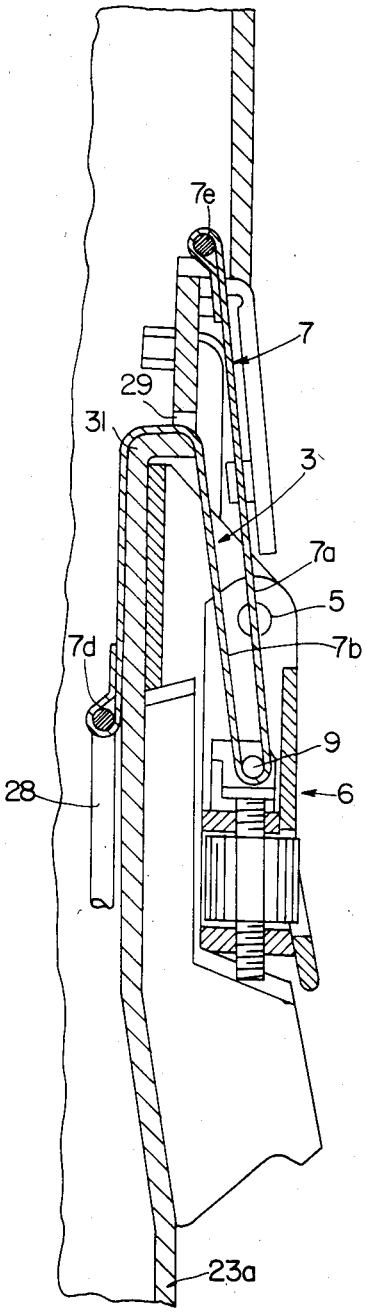
FIG. 8 is a vertical and longitudinal section view, of an application of the device to clamping of the instep of the foot of a skier.

In a further embodiment shown in FIG. 8, strap 7 is used to assure the tensioning of a cable 28 causing clamping of the instep of the foot of the skier. Cable 28 extends, in the usual way, vertically to the interior of the rear part 23*a* of the boot upper, along the rear wall of the latter, and is hooked, at its upper end, to a lower end 7*d* of strap 7. The latter is hooked, at its upper end 7*e*, to a point at the rear wall of the upper. From its upper end 7*e*, strap 7 extends downward, forming a loop around counter-element 9 carried by lever 6 which is mounted for pivoting movement on the rear part 23*a* of upper 23. Strap 7 then extends upwardly, forming a loop, then passes through a hole 29 in the rear wall, and extends downwardly up to its lower end 7*d* which is attached to cable 28. In its passage through hole 29, strap 7 slides on the rounded lower edge 31 of hole 29 which forms a counter-element, creating with strap 7 a loop opening toward the bottom. Here again, downward pivoting movement of lever 6, to closure position, causes shortening of strap 7 and, since its upper end 7*e* is fixed, upward movement of its lower end 7*d* and upward traction on cable 28 for clamping the instep of the skier's foot.

What is claimed is:

1. Device for tensioning a flexible element assuring a connection between two parts, applicable particularly to the closure and tightening of a ski boot on the foot of a skier, about a transverse axis, said lever controlling the tensioning of said flexible element which is attached at its respective ends to said two parts, wherein said flexible element passes around a first, movable counter-element (9) carried by said tensioning lever (6), forming a first loop (7*a*, 7*b*), then passes around a second, fixed counter-element (11; 16; 27; 31), forming a second loop (7*b*, 7*c*,) said flexible element (7) and said two counter-elements (9; 11; 16; 27) constituting the equivalent of a clamp.

2. Device according to claim 1, wherein said second, fixed counter-element (11) is located on that side of the pivoting axis (5) of said lever (6) which is opposite to the side where said first, movable counter-element (9) is located when said lever is flat on its support (3) in tensioning position.

3. Device according to claim 1 or 2, comprising means enabling adjustment of the tension to which said flexible element (7) is subjected when said lever (6) is in closure position.

4. Device according to claim 3, wherein said tension adjusting means comprise means (13 to 15) enabling longitudinal displacement, on said lever (6), of the position of said first counter-element (9) on which passes said flexible element (7) to from said first loop (7*a*, 7*b*).

5. Device according to claim 4, wherein said second, fixed counter-element (11) is constituted by a rear rim of a web portion (3*a*) of said support (3) of said lever (6).

6. Device according to claim 5, wherein said rim (11) is arched toward the exterior and said flexible element (7) passes around said rim and then under said web portion (3*a*) to its point of attachment (12).

7. Device according to any one of claims 4 to 6, wherein said movable counter-element (9) is constituted by an axle extending between two wings of a cap (13) whose position is longitudinally adjustable inside said lever (6), a web portion of said cap being solid with a longitudinally threaded rod (14) which extends through a hole in a transverse wall (6*a*) of said lever against which abuts a knurled nut (15) screwed on an end of said rod (14).

8. Device according to claim 3, wherein said tension adjusting means are provided to adjust the longitudinal position of said second counter-element (16) of said flexible element (7).

9. Device according to claim 8, wherein said support (3) of said lever (6) carries, under its web (3*a*), a longitudinally movable slab (17) having a rack (18) in its upper face, said slab terminating at its rear end in a rim (16) arched toward the exterior and constituting said second counter-element, and an endless screw (21) engaging with teeth of said rack and mounted for rotation about a longitudinal axis, between two wings extending from said web (3*a*) of said support (3).

10. Device according to claim 1 or 2, wherein said first and second counter-elements extend parallel to one another.

11. Device according to claim 1 or 2, wherein said counter elements (9, 27) are inclined with respect ot one another, said second element constituting an element of lateral deviation of said flexible element.

12. Device according to claim 1 or 2, wherein said second counter-element (31) is constituted by a rounded edge of a hole (29) formed in a wall of said boot and traversed by said flexible element (7).

13. Device according to claim 1, wherein said flexible element is used to assure the tensioning of a cable causing clamping of the instep of the foot of the skier, said cable extending vertically, inside a rear portion of an upper of said boot, along a rear wall of the latter, said cable (28) being hooked, at its upper end, to a lower end (7*d*) of said flexible element (7) which is hooked at its upper and (7*e*) at a point on said rear wall of said upper, said flexible element extending, from its upper end (7*e*), downwardly to form a loop about said counter-element (9) carried by said lever (6) which is pivotably mounted on said rear portion (23*a*) of said upper (23), and then reascends, forming a loop, then passes through a hole (29) in said rear wall, and redescends up to its lower end (7*d*) which is hooked to said cable (28) to form a loop opening downwardly.

14. Device according to claim 1 or 2, wherein said flexible element (7) is constituted by a flat strap.

* * * * *